US006874497B2

(12) United States Patent
Yeung

(10) Patent No.: US 6,874,497 B2
(45) Date of Patent: Apr. 5, 2005

(54) RANGE HOOD CLEANING FLUID RESERVOIR AND HEATING SYSTEM

(76) Inventor: Peter Yeung, 4446 Francis Street, Burnaby, British Columbia (CA), V5C 2R4

( * ) Notice: Subject to any disclaimer, the term of this patent is extended or adjusted under 35 U.S.C. 154(b) by 0 days.

(21) Appl. No.: 10/313,520

(22) Filed: Dec. 5, 2002

(65) Prior Publication Data

US 2004/0045544 A1 Mar. 11, 2004

(30) Foreign Application Priority Data

Sep. 10, 2002 (CA) ..... 2402106

(51) Int. Cl.[7] ..... F24B 13/00
(52) U.S. Cl. ..... 126/299 E; 126/299 R
(58) Field of Search ..... 126/299 E, 299 R

(56) References Cited

U.S. PATENT DOCUMENTS 3,751,885 A * 8/1973 McNeely ..... 96/242
3,795,181 A 3/1974 Lawson
4,085,735 A 4/1978 Kaufman et al.
4,259,945 A 4/1981 Lawson
5,158,429 A * 10/1992 Chiang et al. ..... 415/121.3
5,323,762 A * 6/1994 Chiang et al. ..... 126/299 E
5,359,990 A 11/1994 Hsu
5,469,837 A * 11/1995 Chiang et al. ..... 126/299 D
5,874,292 A 2/1999 McMinn, Jr.
6,662,800 B2 * 12/2003 Yeung ..... 126/699
6,712,068 B1 * 3/2004 Yeung ..... 126/299 E
6,732,729 B2 * 5/2004 Yeung ..... 126/299 D

FOREIGN PATENT DOCUMENTS

JP 11063612 3/1999

* cited by examiner

*Primary Examiner*—Alfred Basichas
(74) *Attorney, Agent, or Firm*—Michael A. Glenn; Glenn Patent Group

(57) ABSTRACT

A range hood cleaning fluid reservoir that is connected to the motor housing of the range hood. The reservoir is shaped and sized to fit below the motor housing, preferably in abutment. The reservoir may be equipped with a heating system such as a heating element or a heat conductor system wherein a conductive material is connected to the motor housing and to the interior of the reservoir.

10 Claims, 8 Drawing Sheets

RANGE HOOD CLEANING FLUID RESERVOIR AND HEATING SYSTEM

FIELD OF THE INVENTION

The present invention relates to range hood cleaning fluid reservoirs, and more particularly to a cleaning fluid reservoir for a range hood wherein cleaning fluid used to remove grease from the fans and interior of a motor housing is heated.

BACKGROUND OF THE INVENTION

Range hoods are used above cooking surfaces to remove grease, common odors and hazardous gases created during the cooking process. Typically, range hoods have a pair of motors horizontally installed in a motor housing within the hood body. Each motor drives a fan. The fans draw air from the cooking area below and force it through the motor housing to ventilation piping.

As the vaporized grease in the entrained air travels through the motor housing, some of it condenses on the inside walls of the housing and may accumulate. It is therefore known to provide a cleaning fluid under pressure in order to dean the interior of the exhaust system. U.S. Pat. No. 4,259,945 teaches an exhaust system in which a cleaning fluid under pressure is used to clean the flue and fan. Further washing fluid systems are taught in U.S. Pat. Nos. 3,795,181 and 4,085,735. These prior art cleaning systems are specific to their respective range hood/exhaust duct designs and each relies on an external source of cleaning fluid.

It is also known in the art to place a refillable reservoir within the interior of the range hood so as to provide an internal supply of washing fluid. The reservoir is constructed of plastic in order to remove any concerns with respect to rust and is attached to the upper surface of the range hood body, towards the front of the range hood and separate from the motor housing. Fluid delivery means connected to the reservoir deliver fluid under pressure from the reservoir to the interior surfaces of the range hood, in particular the motor housing. The reservoir may be filled through a coverable hole located in the range hood exterior. Once used, the washing fluid and any grease travelling therewith drains to an external grease receptacle.

Because the reservoir is spaced apart from the motor housing, the temperature of the fluid contained within it remains at approximately room temperature. However, cleaning fluid becomes more effective at removing grease as its temperature increases. In addition, there is limited space available to accommodate the reservoir within the range hood body so its size remains limited.

It is therefore an object of an embodiment of the present invention to provide a range hood having a cleaning fluid reservoir that promotes heating of the fluid within.

It is a further object of an embodiment of the present invention to provide a space saving design for a cleaning fluid reservoir for a range hood such that the size of the range hood may be decreased in size relative to the range hoods of the prior art.

It is yet a further object of an embodiment of the present invention to provide a cleaning fluid reservoir that has greater capacity than the cleaning fluid reservoirs of the prior art.

Other objects of the invention will be apparent from the description that follows.

SUMMARY OF THE INVENTION

According to the present invention there is provided a cleaning fluid reservoir for use with a range hood having a motor housing. The cleaning fluid reservoir comprises a solid outer shell defining an enclosure having an inlet and an outlet, with the enclosure positioned substantially under the motor housing.

Other aspects of the present invention include the following:

a. The reservoir is in abutment with the motor housing.

b. The motor housing has two air inlets to which may be releasably attached two respective grease trays.

c. The enclosure defines a front, rear and main chamber.

d. When a set of two grease trays is attached to the motor housing, one to each of the air inlets, the reservoir is positioned between the trays.

e. The reservoir further comprises a heating system.

f. The heating system comprises a heating element located within the enclosure.

g. The heating system comprises a heat conductor having a first portion connected to the motor housing and a second portion located within the enclosure of the reservoir.

h. The first portion of the heat conductor comprises a heat conducting metal lattice which abuts the motor housing.

i. The metal lattice is a metal plate.

j. The second portion of the heat conductor comprises heat conducting wires.

k. The heat conducting wires are attached to the metal lattice and pass through a hole in the reservoir so as to be positioned within the enclosure of the reservoir.

According to an alternative embodiment of the invention there is provided a cleaning fluid reservoir for use in a range hood having a motor housing wherein the reservoir comprises a solid outer shell defining an enclosure having an inlet and an outlet and a heating element located within the enclosure.

According to a further alternative embodiment of the invention there is provided a cleaning fluid reservoir for use in a range hood having a motor housing wherein the reservoir comprises a solid outer shell defining an enclosure having an inlet and an outlet and a heating system comprising a conductive metal lattice connected to the motor housing and heat conducting wires connected to the metal lattice. The wires travelling from the metal lattice into the enclosure of the reservoir.

Other aspects of the invention will be appreciated by reference to the detailed description of the preferred embodiment and to the claims that follow.

BRIEF DESCRIPTION OF THE DRAWINGS

These and other features of the invention will become more apparent from the following description in which reference is made to the appended drawings and wherein.

DETAILED DESCRIPTION OF THE PREFERRED EMBODIMENT

Figure 1:
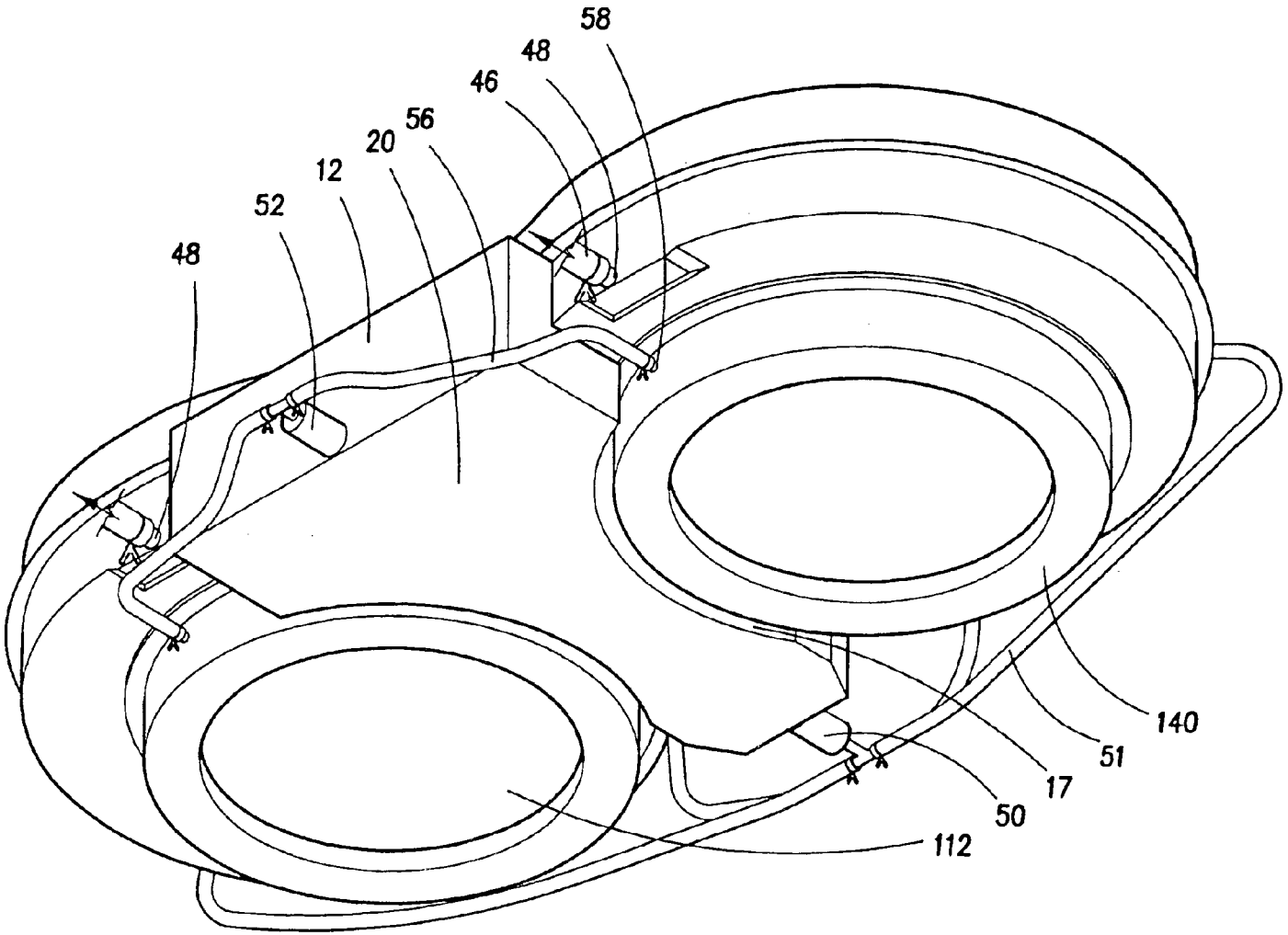
FIG. 1 is a perspective view from the bottom rear of a motor housing with the fan and motor removed and showing the cleaning fluid reservoir according to the preferred embodiment of the invention.

The preferred embodiment of a refillable reservoir 20 according to the invention is best illustrated in FIG. 1.

Figure 2:
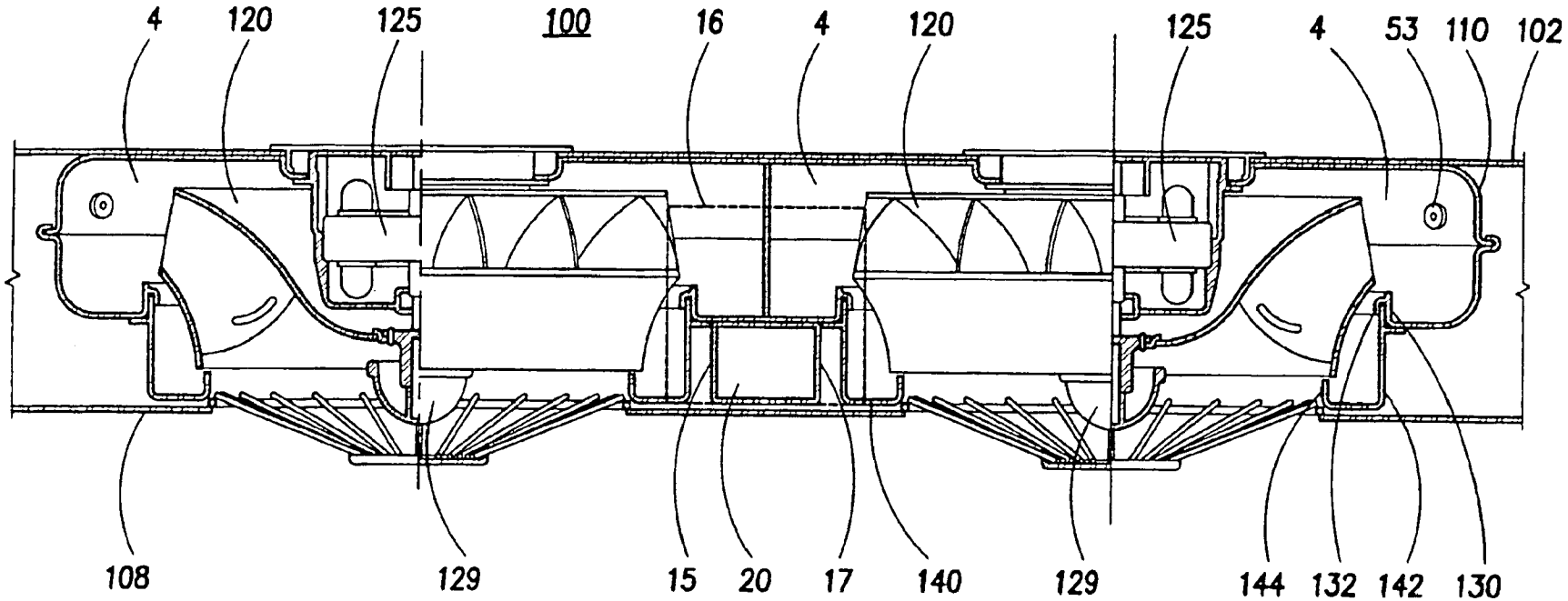
FIG. 2 is a cross sectional view from the rear of a range hood with the motor housing and cleaning fluid reservoir according to the preferred embodiment, with the left and right hand portions providing a deeper sectional view than the middle portion of the figure.
Figure 3:
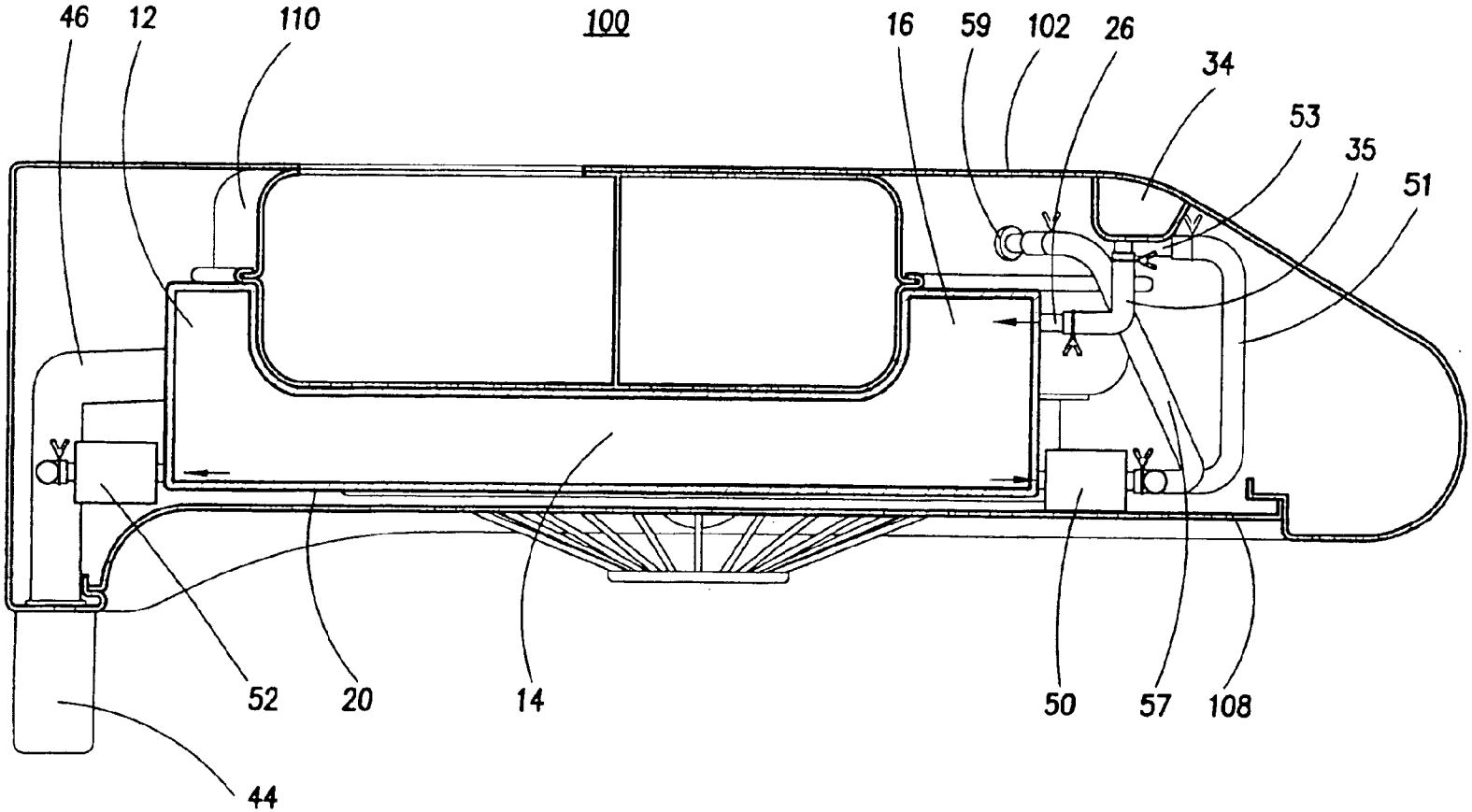
FIG. 3 is a cross sectional view from the left side of the range hood shown in FIG. 2.
Figure 4:
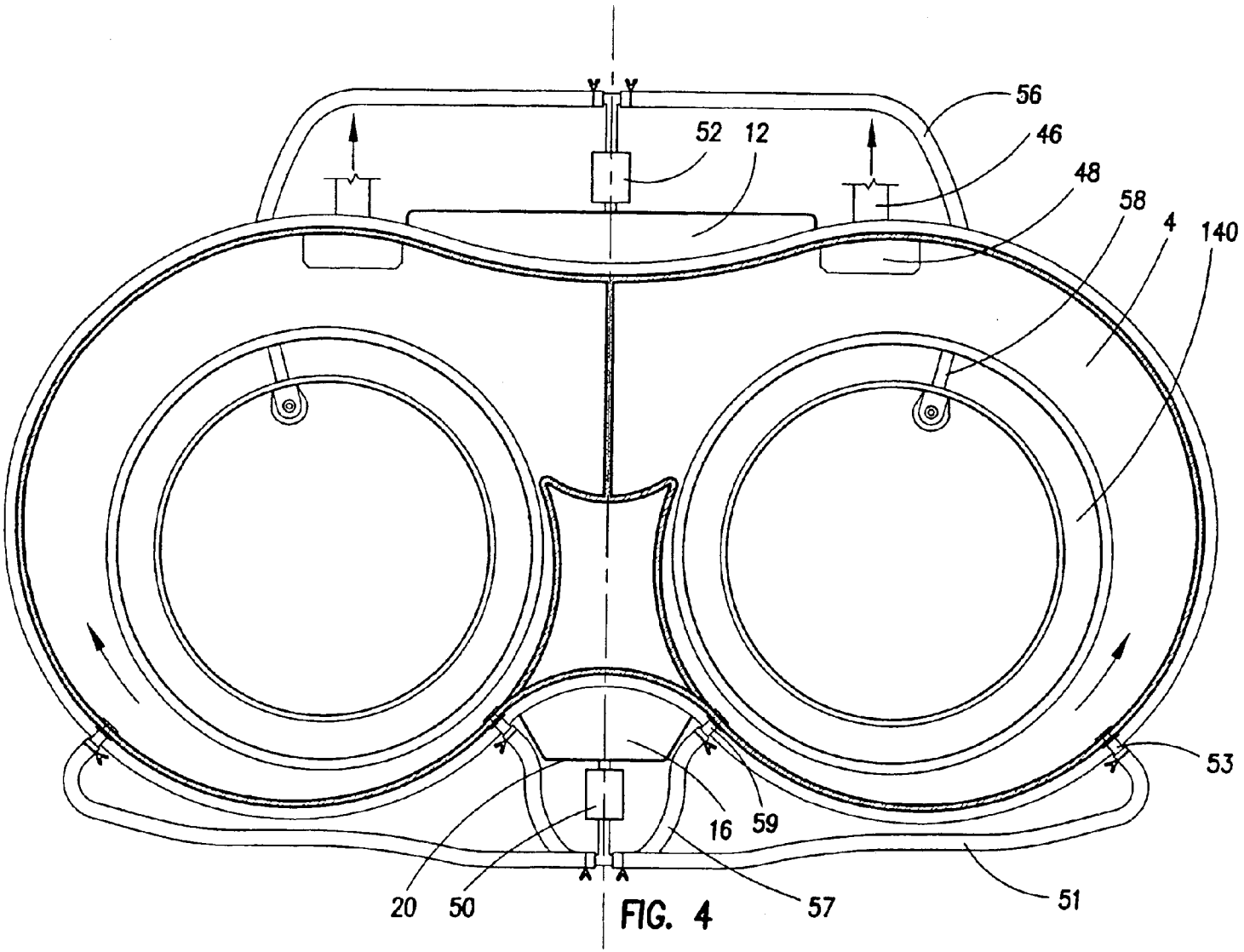
FIG. 4 is a sectional view through the top of the motor housing and cleaning fluid reservoir shown in FIG. 1.

FIGS. 2 and 3 show a range hood 100 having the refillable reservoir 20 of the present invention. Range hood 100 is designed to be mounted above a home cooking surface in order to facilitate the removal of grease laden cooking vapors and the like generated while cooking. The motor housing 110 defines an enclosure and is mountable within a further enclosure formed by the range hood body 102. Preferably the motor housing is made of metal. The interior of the housing 110 may be coated with a non-stick material so as to facilitate grease removal and is separated into two substantially similar, separate chambers 4, as shown in FIGS. 2 and 4. Each chamber 4 has an air inlet 112 (shown in FIG. 1) and a ventilation hole (not shown).

A motor 125 is fitted in each chamber 4 of the motor housing 110 and is attached to the inside of the upper surface of the range hood body 102. A fan 120 is secured to each of the motors 125 by fan caps 129, and acts to draw grease-laden air into the motor housing 110 where it is forced out the ventilation holes.

The motor housing 110 acts as an integral grease catcher and includes walls 130 depending and rising vertically from the lower surface of the motor housing into each chamber 4 thereby defining the air inlets 112. An outwardly and downwardly projecting extension or lip 132 depends from wall 130, so as to form a gap between the lip 132 and wall 130. Extension 132 may diverge from wall 130 such that the gap forms a wedge surface. A grease tray 140 is dimensioned such that its outer wall 142 may be releasably connected within gap 134. Inner wall 144 preferably has a diameter less than that of the lower edge of the fan 120.

Preferably, the motor housing 110 is of reduced height such that fans 120 extend down through the air inlets 112, below the lower level of the motor housing as shown in FIG. 2. The grease tray 140 is shaped so as to accommodate the fan extending out of the motor housing 110. This configuration increases the amount of space available between the trays 140 when they are attached to the motor housing and between the bottom of the motor housing 110 and the lower panel 108 of the range hood, without an increase in the overall size of the range hood. The motor housing 110 is shaped such that its lower surface slopes from front to back, thereby causing liquid within its interior to drain towards drainage holes 48 located at the lowest point of each chamber of the motor housing. Upon passing through drainage holes 48, the liquid (cleaning fluid and grease) travels through drainage hose 46 to external grease cup 44, which must be emptied periodically.

Figure 5:
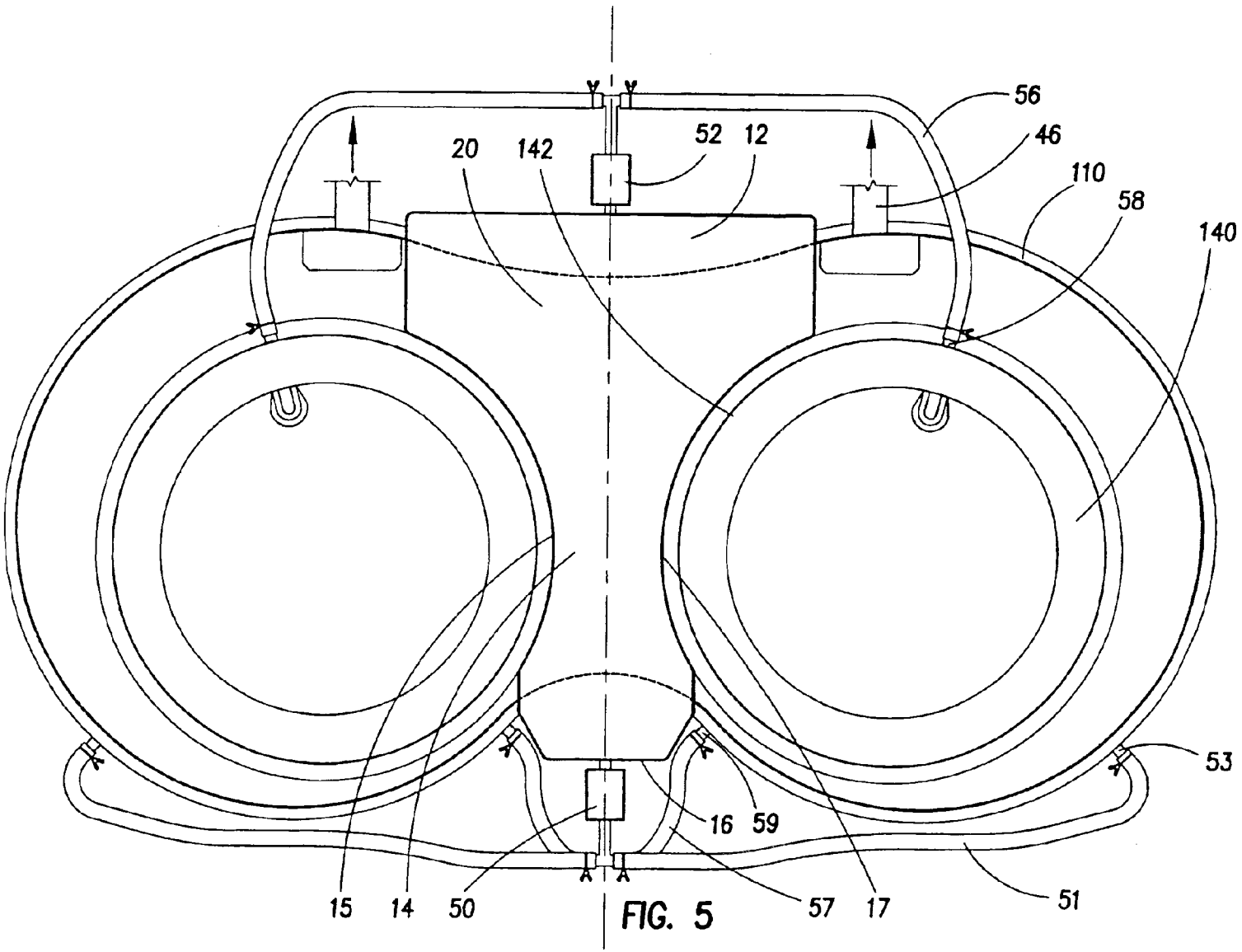
FIG. 5 is a plan view from the bottom of the motor housing and cleaning fluid reservoir shown in FIG. 1.

The reservoir 20 has a solid outer shell defining an enclosure having a front chamber 16, main chamber 14 and back chamber 12. Preferably, the reservoir 20 is made of plastic and is positioned under and in abutment to the motor housing 110. However, it is contemplated that other materials could be used and that the reservoir need only be positioned under and in close proximity to the motor housing. It is preferred that the reservoir 20 be shaped so that it travels below the motor housing from the front to the rear and between grease trays 140 as shown in FIGS. 1–5. The reservoir 20 is dimensioned such that sufficient space is present between the sides 15, 17 of the reservoir 20 and the outer walls 142 of the trays 140 to allow the trays to be removed without obstruction in order to access the interior of the motor housing 110, as best shown in FIGS. 2 and 5. The front and back chambers 16, 12 extend approximately half way up the front and back sides, respectively, of the motor housing, however the precise positioning is not essential. The bottom surface of the reservoir is in substantially the same plane as the bottoms of the grease trays 140. Preferably, the reservoir 20 is releasably connectable to the motor housing, however this is not essential. The back chamber 12 of the reservoir follows the contour of the back of the motor housing so as to make best use of all the space available to it.

The reservoir may be filled by pouring cleaning fluid into a fill hole 34 located in the upper surface of the range hood body 102. The fluid travels through hose 35 and inlet valve 26 and into the reservoir. The reservoir is also equipped with at least one fluid outlet. In the preferred embodiment the reservoir is equipped with both a front and a rear outlet and accompanying pumps 50, 52. Pump 52 pumps cleaning fluid from reservoir 20 through conduits 56 to nozzles 58 which pass through trays 140 and direct the pressurized cleaning fluid towards the fans 120 and motor housing chambers 4. Pump 50 pumps cleaning fluid from reservoir 20 through conduits 51 and 57 to respective nozzles 53 and 59 mounted in the side of the motor housing 110 and direct a spray of cleaning fluid into the motor housing chambers 4. The positioning of the fluid inlets and outlets and the pumps is not an essential feature of the invention.

In the preferred embodiment the reservoir is in abutment with the motor housing 110, positioned below the motor housing between the two grease trays. During cooking, the motor housing temperature increases substantially as a result of hot air drawn into it from above the cooking surface. By positioning the reservoir 20 below the motor housing, heat from the motor housing may be conducted to the fluid within the reservoirs. The combination of heat conducted from the motor housing and heat from the cooking surface below is sufficient to raise the temperature of the cleaning fluid above that of the normal room temperature. Raising the temperature of the cleaning fluid increases its cleaning performance and renders it more effective at removing grease that it comes into contact with.

The unique positioning of the reservoir allows it to contain a greater volume of fluid than the prior art reservoirs. In addition, the overall size of the range hood may be decreased as compared to the prior art range hoods with the same size of motor housing.

Figure 6:
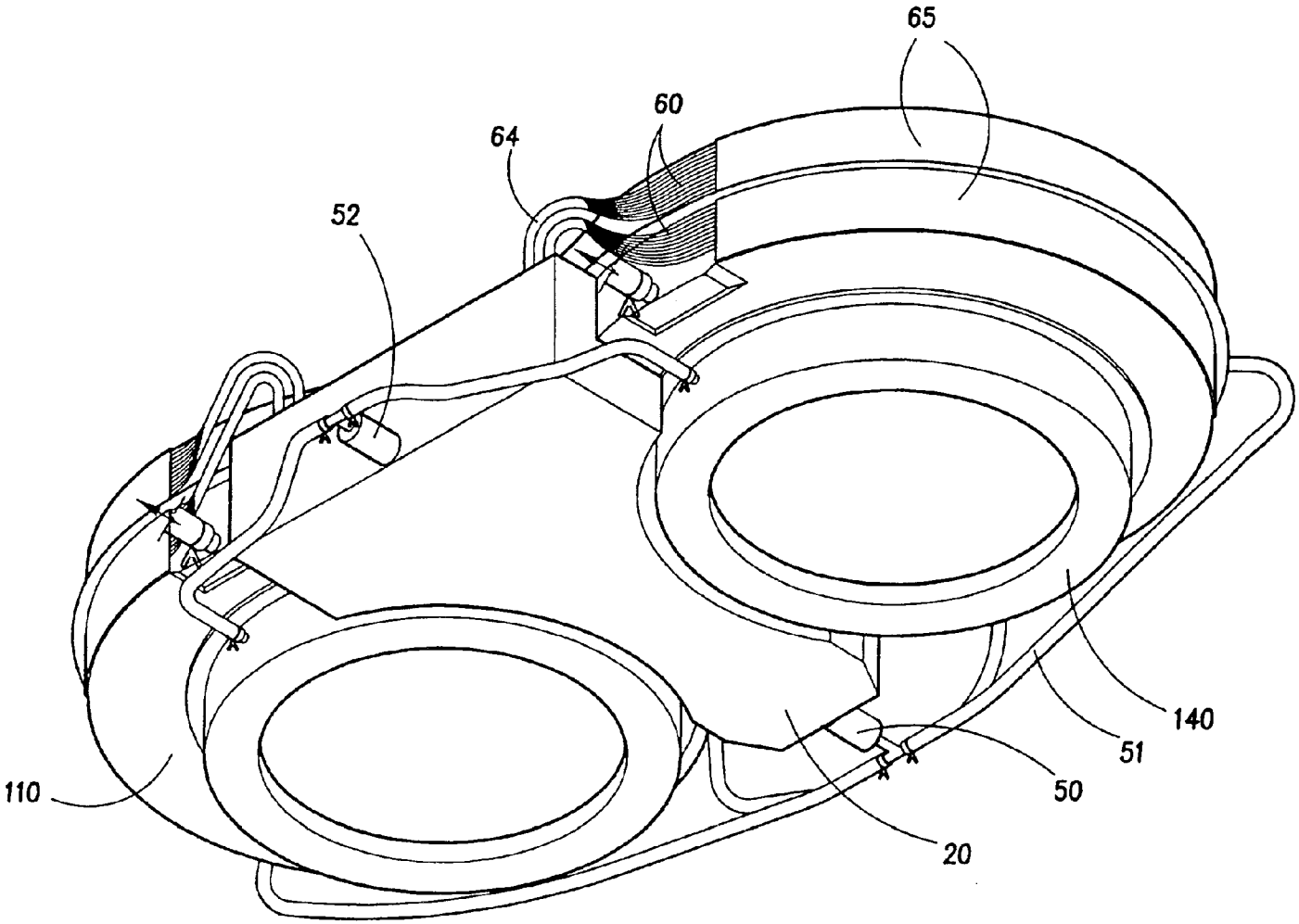
FIG. 6 is a perspective view from the bottom rear of a motor housing with the fan and motor removed and showing a cleaning fluid reservoir with a heating system according to an alternative embodiment of the invention.
Figure 7:
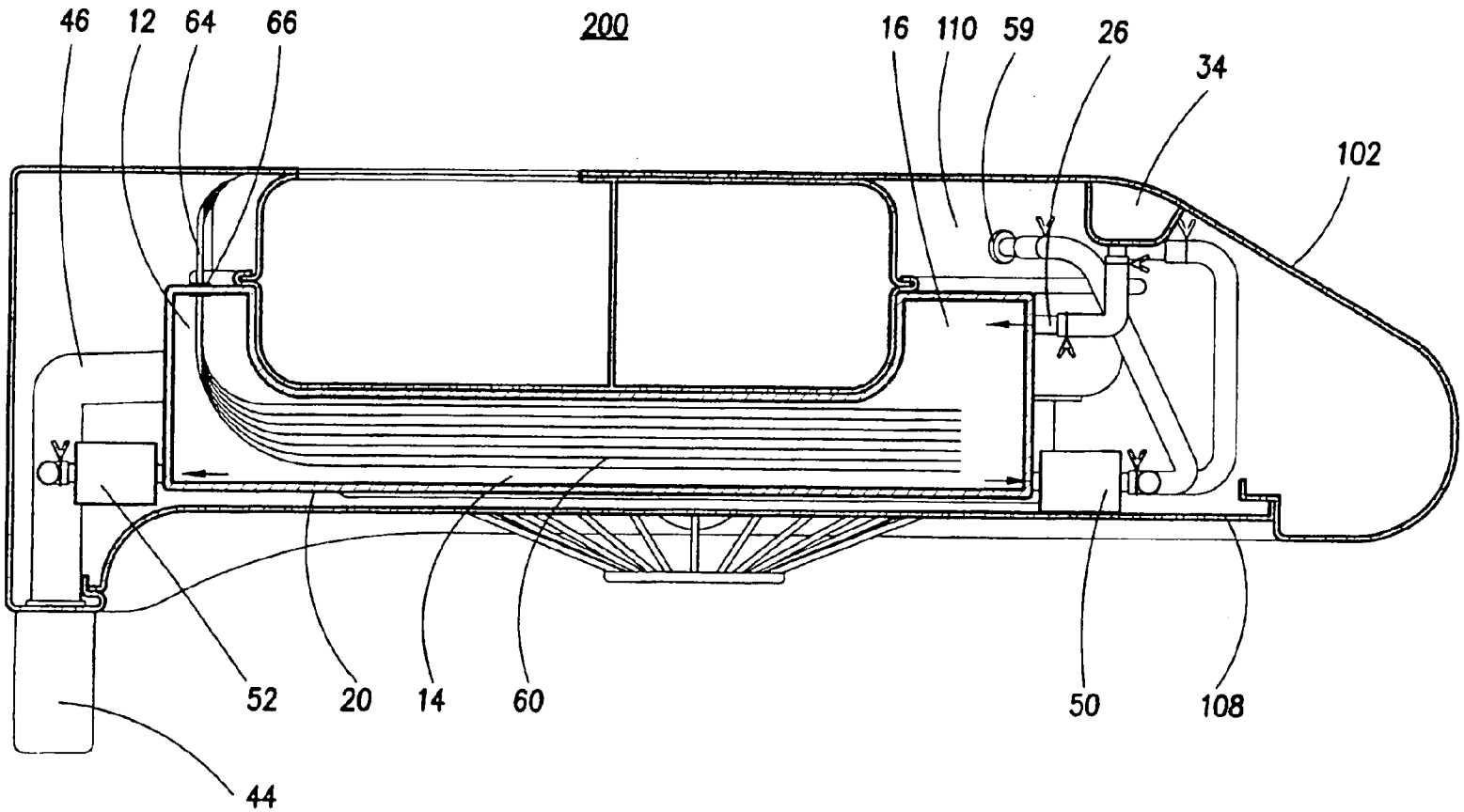
FIG. 7 is a cross sectional view from the left side of a range hood having the motor housing, cleaning fluid reservoir and heating system shown in FIG. 6.

While more costly to produce, further embodiments of the invention may incorporate additional heating systems to further improve the cleaning effectiveness of the cleaning fluid by maintaining it at a higher temperature than would be attainable without such systems. Such an alternate embodiment is shown in FIGS. 6 and 7, where the range hood 200 has an additional heating system in place. Components identical to those of the preferred embodiment have been identified with identical reference numbers. In this embodiment, a heat conductor system has a first portion adapted to draw heat from the motor housing and a second portion adapted to conduct heat from the first portion to the reservoir. Preferably the first portion is a conductive metal lattice 65 connected to the outside of the motor housing 110. The second portion is preferably comprised of heat conducting wires 60. The heat conducting wires 60 extend from the metal lattice 65 and join together to form a single heat conducting unit 64 which passes through hole 66 in reservoir 20. Once in reservoir 20, the heat conducting wires 60 once again spread apart so as to better conduct heat from the motor housing 110 to the cleaning fluid contained within the reservoir 20.

Preferably the metal lattice 65 is in the form of a molded plate of metal with the heat conducting wires 60 embedded therein, both the plate of metal and the wires being made of a highly heat conducting metal such as copper or the like. However, it is contemplated that any form of heat conducting material may be attached to the motor housing, provided that it can abut the metal of the motor housing in order to get proper conduction and that it may pass into the reservoir 20 so as to conduct heat from the motor housing 110 to the cleaning fluid in the reservoir 20.

Figure 8:
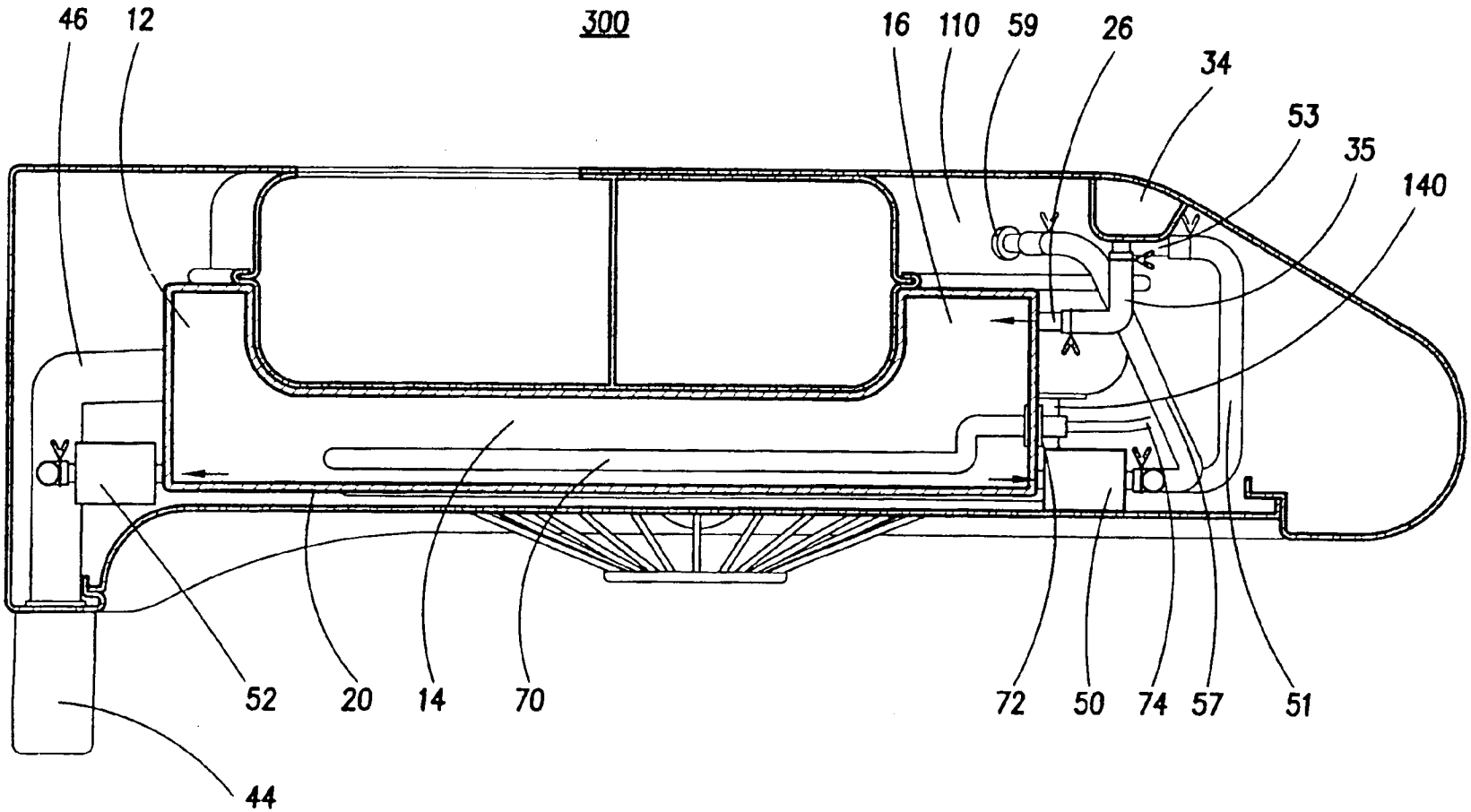
FIG. 8 is a cross sectional view from the left side of a range hood having a motor housing and cleaning fluid reservoir with a heating system according to a further alternative embodiment of the invention.

A further alternative embodiment is shown in FIG. 8. The range hood 300 has a heating element 70 in the reservoir 20. The heating element 70 enters the reservoir 20 through sealed hole 72 and is provided power through power cable 74. The heating element may be activated manually or automatically and provides low level heating in order to raise the temperature of the cleaning fluid so as to make it more effective in removing grease from the fans and motor housing. It is anticipated that the heating element may be equipped with a kill switch in the event that the level of the cleaning fluid drops to such a level that the heating element could overheat.

It is also contemplated that both the heat conductor and the heating element heating systems may be used in conjunction with the reservoirs of the prior art. In other words, the use of these systems is not limited to the reservoir of the preferred embodiment—the reservoir could be located elsewhere within the body of the range hood and still be equipped with one of the heating systems described herein or their equivalent.

It will be appreciated by those skilled in the art that the preferred and alternative embodiments have been described in some detail but that certain modifications may be practiced without departing from the principles of the invention.

What is claimed is:

1. A cleaning fluid reservoir for use with a range hood having a motor housing, said cleaning fluid reservoir comprising:

a solid outer shell defining an enclosure having an inlet and an outlet, said enclosure positioned substantially under said motor housing;

wherein said motor housing having top, bottom and perimeter surfaces defining an enclosure within which at least one motor and at least one fan are mounted, said motor housing having an air outlet and at least one air inlet and being mounted within a hood body of said range hood, said hood body having top, bottom, front, rear and side panels forming a further enclosure, said hood body having at least one air intake, said range hood being adapted to be mounted above a cooking surface;

further comprising a heating system, wherein said heating system comprises a heat conductor having a first portion connected to said motor housing and a second portion located within said enclosure of said reservoir.

2. The cleaning fluid reservoir of claim 1 wherein said reservoir is in abutment with said motor housing.

3. The cleaning fluid reservoir of claim 1 or 2, wherein said motor housing has two air inlets to which may be releasably attached two respective grease trays.

4. The cleaning fluid reservoir of claim 3 wherein said enclosure defines a front, rear and main chamber.

5. The cleaning fluid reservoir of claim 3, wherein when a set of two grease trays is attached to said motor housing, one to each of said air inlets, said reservoir is positioned between said trays.

6. The cleaning fluid reservoir of claim 1, wherein said first portion comprises a heat conducting metal lattice which abuts the motor housing.

7. The cleaning fluid reservoir of claim 6, wherein said second portion comprises heat conducting wires.

8. The cleaning fluid reservoir of claim 6, wherein said second portion comprises heat conducting wires.

9. The cleaning fluid reservoir of claim 8, wherein said heat conducting wires are attached to said metal lattice and pass through a hole in said reservoir so as to be positioned within said enclosure of said reservoir.

10. A cleaning fluid reservoir for use in a range hood having a motor housing wherein said reservoir comprises a solid outer shell defining an enclosure having an inlet and an outlet and a heating system comprising a conductive metal lattice connected to said motor housing and heat conducting wires connected to said metal lattice, said wires travelling from said metal lattice into said enclosure of said reservoir.

* * * * *